United States Patent [19]

Oettinger et al.

[11] 3,974,578

[45] Aug. 17, 1976

[54] TENNIS SHOE TOE CUP

[76] Inventors: Peter E. Oettinger, 4 Phlox Lane; Walter J. Bornhorst, 9 Magnolia Drive, both of Acton, Mass. 01720

[22] Filed: July 23, 1975

[21] Appl. No.: 598,242

[52] U.S. Cl. ..... 36/72 R
[51] Int. Cl.[2] ..... A43B 13/22
[58] Field of Search ..... 36/72 R, 2.5 A

[56] References Cited

UNITED STATES PATENTS

| | | | |
|---|---|---|---|
| 1,354,846 | 10/1920 | Robertson | 36/72 R |
| 2,747,303 | 5/1956 | Abrahams | 36/72 R |
| 3,045,367 | 7/1962 | McKeon | 36/72 R |
| 3,497,972 | 3/1970 | Lyman | 36/72 R |

FOREIGN PATENTS OR APPLICATIONS

| | | | |
|---|---|---|---|
| 18,565 | 1901 | United Kingdom | 36/72 R |

*Primary Examiner*—Alfred R. Guest
*Attorney, Agent, or Firm*—Kenway & Jenney

[57] ABSTRACT

This invention discloses a means for protecting the toe of a tennis shoe, and comprises a flexible cup-shaped molded elastomer whose inner and outer surfaces are substantially convex, coaxial surfaces of revolution, and which is attached to the toe of a flexible tennis shoe by an elastic adhesive. The elastomer cup and elastic adhesive are both characterized by flexibility substantially similar to that of the shoe. Some embodiments of the invention include a recessed cross-lined pattern on the inner surface of the cup to promote adhesion to the shoe.

4 Claims, 4 Drawing Figures

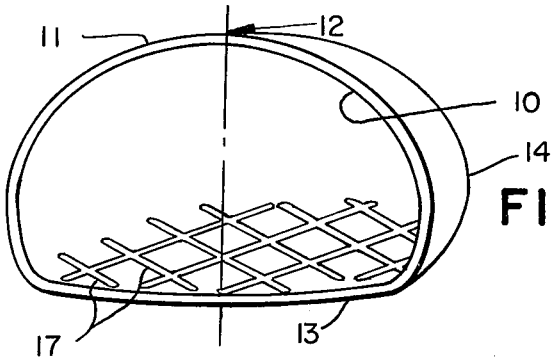
FIG. 1
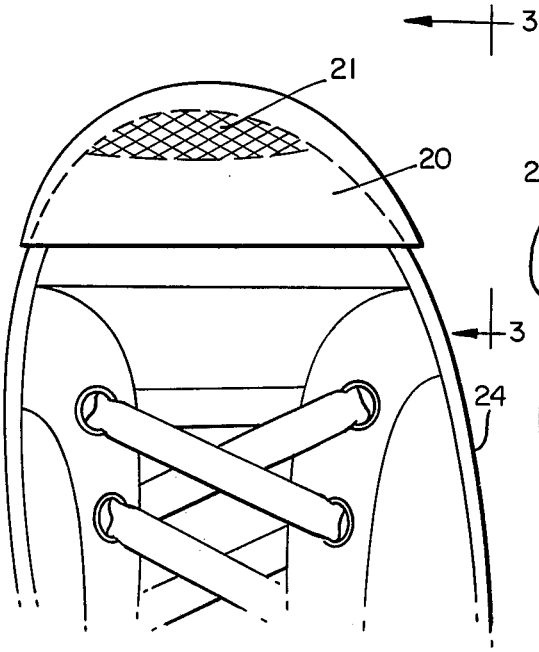
FIG. 2a
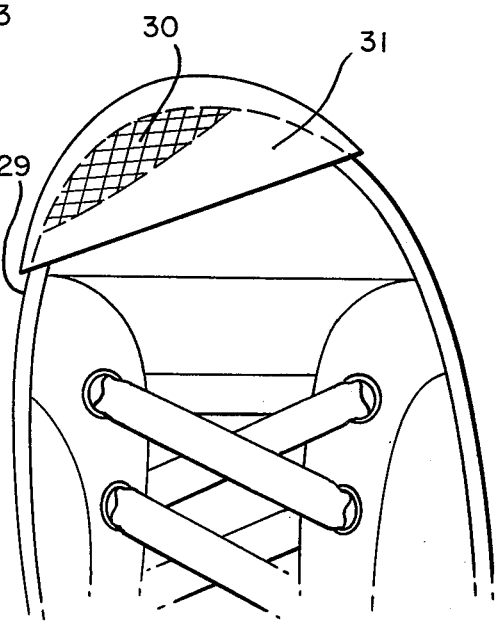
FIG. 2b
FIG. 3
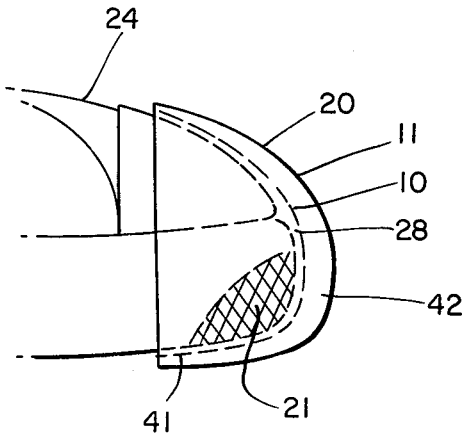

TENNIS SHOE TOE CUP

BACKGROUND OF THE INVENTION

This invention relates to athletic footwear and more particularly, to a device used for the repair and/or protection of tennis shoe tips. Such a device is useful to a tennis player who, by the normal motion of dragging his back foot while hitting the ball, wears down the toe of his tennis shoe long before the remainder of the shoe is worn out. This type of damage to tennis shoes is a common and widespread problem among tennis players.

At present, the following two methods may typically be used for repairing tennis shoe tips: professional replacement of a portion of the sole near the toe of the shoe, and application of a fluid elastomer onto the damaged area of the shoe so that the elastomer, upon curing, forms a permanently contacted flexible patch. Replacement of a portion of the sole by a professional shoe repairman is expensive and deprives the player of the use of his tennis shoes for the duration of the repair period, including the time to transport the shoes to and from the repair station. On the other hand, a fluid elastomer patch may be applied by the player, thereby eliminating much of the expense and delay associated with the partial sole replacement approach. However, correct application of the fluid elastomer, by the player, in order to form a well-tailored patch is difficult. The coating must be sufficiently thick over its central portion to maximize the life of the patch against wear, yet be sufficiently thin at the edges to insure user safety and comfort. Another disadvantage of the fluid elastomer patch is the difficulty in achieving a uniformly sound bond at the edges of the patch.

Protective caps for toes of shoes and boots in general are known in the prior art. However, such caps are not suitable for tennis shoes where they would be subjected to high and rapid flexure, as, for example, occur during strenuous tennis play, since no provision is made to match the elasticities of the cap, shoe, and adhesive in order to prevent separation of the cap from the shoe. Furthermore, no provision exists in the prior art caps which allows a single cup to be positioned off-center to either side of a right or left shoe, which would permit it to cover the damaged regions of the shoes of a large number of tennis players who sustain such wear.

It is the object of the present invention to provide an improved means for the protection of the toe of a tennis shoe which is easily attached to a tennis shoe.

A further object is to provide an improved means for the protection of the toe of a tennis shoe which is readily adaptable to a plurality of mounting positions on the shoe.

A further object of the invention is to provide a protective toe cup for a new or non-worn tennis shoe tip to prevent damage thereto by covering the front of the shoe with this cup.

SUMMARY OF THE INVENTION

According to the present invention, a preformed, molded elastomer shoe tip is provided in the form of a cup having inner and outer surfaces which are portions of substantially convex surfaces of revolution about a common reference axis. The cup has a flexibility substantially similar to that of a typical tennis shoe, permitting conformance to many styles and sizes of right and left tennis shoes. The cup can be positioned on a shoe to be cocked off-center, if necessary, to cover any damaged surface at the tip and adjoining regions of the shoe.

Furthermore, a flexible adhesive is positioned on the inner surface of this cup, wherein the adhesive has an elasticity substantially matching that of the cup. As a result, the cup may be bonded by the player to a tennis shoe having a sole with elasticity also substantially matching that of the cup and adhesive. The elastomer cup and elastic adhesive combination allows excellent adhesion of the cup to the shoe in on-center, or off-center cocked, positions, even during periods of strenuous play, wherein the shoe is substantially and rapidly flexed.

From the preceding statements and the succeeding detailed description and accompanying illustrations, the invention is seen to consist of new and useful constructions, combinations, and arrangements of parts.

DESCRIPTION OF THE DRAWINGS

FIG. 1 is a perspective view of an exemplary flexible toe cup in accordance with the present invention.

FIG. 2*a* is a top view of an exemplary cup centered on the toe of a shoe.

FIG. 2*b* is a top view of an exemplary cup cocked off-center on the toe of a shoe.

FIG. 3 is a side view of the configuration of FIG. 2*a*.

DESCRIPTION OF THE PREFERRED EMBODIMENT

Referring to the accompanying illustrations, FIG. 1 shows a perspective view of the elastomer cup of the present embodiment, molded to the geometrical configuration of an averaged-sized, standard-styled, tennis shoe toe. Both the inner 10 and outer 11 surfaces of the cup are portions of substantially convex surfaces of revolution about a common reference axis 12. The bottom edge 13 is relatively flat to conform to the sole of the shoe. This edge is relatively thin in order to prevent injury to, and insure comfort of, the player. The tip 14 is approximately twice the thickness of the bottom edge in order to extend the life of the cup against wear. The inner surface of the toe cup may be roughened, in some embodiments, for example, by a recessed crossed-groove pattern 17 shown in FIG. 1, which enhances bonding of the cup to the shoe. In one embodiment, for example, a plurality of crossed parallel grooves may be used wherein each groove is 0.1–0.35 mm deep, 0.1–0.35 mm wide and wherein the intergroove spacing is 1–5 mm.

In FIG. 2*a*, an exemplary toe cup 20 is shown bonded, on-center, with a flexible adhesive, to the toe of tennis shoe 24. The cup 20 completely covers a damaged area 21 (cross-hatched) of shoe 24 and adheres to both the sole and upper portions of the shoe 24.

As shown in FIG. 2*b*, a shoe 29 includes a damaged area 30 somewhat removed from the center of the toe. The exemplary toe cup 31 is positioned to be cocked off-center to one side of the shoe 29, in a manner covering the damaged area 30 (cross-hatched).

FIG. 3 shows a side view of shoe 24 with cup 20 positioned over damaged area 21. The cup 20, bonded on-center to the shoe 24 by adhesive 28 (filling the region between the inner surface of cup 20 and the outer surface of shoe 24) is shown with a relatively thin edge 41 and the thicker tip region 42 of the cup covering the damaged area 21. Because of this thin bottom edge and the usual slight natural curvature of the sole of the shoe 24 near the toe, the cup is hardly felt by the player, and, therefore, causes no discomfort.

A lightweight, inexpensive toe cup in accordance with this invention may be readily manufactured from vinyl using known molding techniques. Elastic adhesives suitable for use with such a toe cup are USM Compositions 4067 and 4045, manufactured by USM Corporation, Bostik Division, Middleton, Mass.

If changes and modifications are made in the details of construction and arrangement of components, it is obvious that these will not depart from the general spirit of the invention.

With the preceding description of our invention, we now claim as new:

1. A toe cup which provides toe protection for a flexible shoe having a sole portion characterized by a predetermined elasticity, comprising a cup-shaped element having an elasticity substantially the same as said predetermined elasticity and having an inner and outer surface, each of said surfaces being a portion of a substantially convex surface of revolution about a reference axis, the angle subtended by each of said portions about said reference axis in a plane perpendicular to said axis being less than or equal to 180° and wherein said inner surface is concave and has a continuous smooth curvature.

2. A toe cup, according to claim 1, further comprising a flexible adhesive on said inner surface, said adhesive having substantially the same elasticity as said predetermined elasticity.

3. A toe cup, according to claim 1, further comprising a grooved pattern on said inner surface, the said pattern comprising a plurality of crossed grooves of recessed vertical and horizontal crossed lines 0.25 millimeters deep and 3 millimeters between adjacent lines.

4. A toe cup according to claim 3 wherein said grooves include two sets of substantially parallel grooves having 1–5 mm intergroove spacing and wherein each groove is 0.1–0.35 mm deep and 0.1–0.35 mm wide.

* * * * *